United States Patent [19]

Hollingsworth

[11] 4,431,531

[45] Feb. 14, 1984

[54] CONCENTRATION OF MINERALS BY FLOTATION APPARATUS

[75] Inventor: Clinton A. Hollingsworth, Lakeland, Fla.

[73] Assignee: The Deister Concentrator Company, Inc., Ft. Wayne, Ind.

[21] Appl. No.: 421,351

[22] Filed: Sep. 22, 1982

Related U.S. Application Data

[63] Continuation-in-part of Ser. No. 271,422, Jun. 8, 1981, abandoned.

[51] Int. Cl.[3] ..... B03D 1/24

[52] U.S. Cl. ..... 209/170; 210/221.2

[58] Field of Search ..... 209/162–165, 209/168–170; 210/221.2, 221.1

[56] References Cited

U.S. PATENT DOCUMENTS

| | | | |
|---|---|---|---|
| 2,758,714 | 8/1956 | Hollingsworth | 209/168 |
| 2,783,884 | 3/1957 | Schaub | 209/165 |
| 3,371,779 | 3/1968 | Hollingsworth et al. | 209/170 X |
| 4,028,229 | 6/1977 | Dell | 209/170 X |
| 4,060,481 | 11/1977 | Stoev et al. | 209/170 |
| 4,287,054 | 9/1981 | Hollingsworth | 209/170 |

*Primary Examiner*—Tim R. Miles

*Assistant Examiner*—James M. McGowan

*Attorney, Agent, or Firm*—Gust, Rickert & Welch

[57] ABSTRACT

The invention relates to the concentration of particulate matter by froth flotation and in particular to improvements in hydraulic-pneumatic flotation apparatus. The apparatus includes an upstanding flotation compartment adapted to contain a relatively quiescent body of aqueous pulp. Aqueous pulp is introduced into and float fraction is collected from the upper portion of the floatation compartment, and a hydraulic chamber is disposed near the bottom of the compartment for supplying aerated water thereto. Retardation plate means spans the flotation compartment intermediate the ends thereof for retarding the descent of pulp therewithin. The plate means is provided with a plurality of apertures to receive rising air bubbles and descending pulp therethrough. Retarding or prolonging the descent of the aqueous pulp within the flotation compartment enhances the probability of floatable particles becoming attached to bubbles and thereby being recovered.

A plurality of such retardation plate means may be used in vertically spaced relation to further enhance the recovery time and also to minimize development of circulating currents within the flotation compartment.

11 Claims, 7 Drawing Figures

CONCENTRATION OF MINERALS BY FLOTATION APPARATUS

This is a continuation-in-part application of application Ser. No. 271,422, filed June 8, 1981, now abandoned.

BACKGROUND OF THE INVENTION

1. Field of the Invention

The present invention relates to hydraulic-pneumatic flotation apparatus and more particularly to improvements for increasing efficiency of operation.

2. Description of the Prior Art

Commercially valuable minerals, for example, metal sulfides, apatitic phosphates and the like, are commonly found in nature mixed with relatively large quantities of gangue materials, and as a consequence it is usually necessary to beneficiate the ores in order to concentrate the mineral content thereof. Mixtures of finely divided mineral particles and finely divided gangue particles can be separated and a mineral concentrate obtained therefrom by well known froth flotation techniques. Broadly speaking, froth flotation involves conditioning an aqueous slurry or pulp of the mixture of mineral and gangue particles with one or more flotation reagents which will promote flotation of either the mineral or the gangue constituents of the pulp when the pulp is aerated. The conditioned pulp is aerated by introducing into the pulp a plurality of minute air bubbles which tend to become attached either to the mineral particles or to the gangue particles of the pulp, thereby causing these particles to rise to the surface of the body of pulp and form thereat a float fraction which overflows or is withdrawn from the flotation apparatus.

Typical such flotation apparatus is disclosed in U.S. Pat. No. 3,371,779. In such apparatus, the conditioned pulp is introduced into a flotation compartment containing a relatively quiescent body of an aqueous pulp, and aerated water is introduced into the lower portion of the flotation compartment through orifices formed in the bottom wall. A body of aerated water is provided in a hydraulic compartment disposed directly below the flotation compartment by introducing air and water into the hydraulic compartment in a manner which disperses a multitude of fine air bubbles throughout the water therein. This body of aerated water is in fluid communication with the aqueous pulp in the lower portion of the flotation compartment through the aforementioned orifices. An overflow fraction containing floated particles of the pulp is withdrawn from the top of the flotation compartment and an underflow or non-float fraction containing non-floated particles of the pulp is withdrawn from the pulp in the lower portion of the flotation compartment.

One problem encountered in such prior apparatus is that a portion of the floatable fraction never becomes attached to rising bubbles and therefore passes out of the discharge as part of the tailings. To overcome this, a second apparatus is joined to the first in vertical tandem relation such that the discharge of the upper apparatus feeds into the upper portion of the lower apparatus, the floatable material entrained in this discharge once again becoming subject to the rising currents of bubbles by means of which it may be recovered. This technique for obtaining an increase of the recovered material is an item of some expense, since it requires a duplication of apparatus.

Furthermore, from an operating standpoint, it is undesirable to have flotation cells at two or more levels. An alternative is to have the two cells at the same level and pump from one cell to the other. Pumping complicates the system and adds to operating costs.

In similar apparatus as disclosed in U.S. Pat. No. 2,758,714 instead of injecting aerated water, aerating air without water is introduced directly into a relatively aquiescent body of aqueous pulp by means of air diffusers which are immersed in or are in direct contact with the pulp. Such air diffusers ordinarily include a porous material through the pores or minute perforations of which minute bubbles of aerating air are directly introduced into the aqueous flotation pulp. The size of such pores determines the size of the bubbles and since tiny bubbles are preferred, the pore size must be minimal. As a consequence, a very troublesome problem is encountered because of the tendency of the air diffusers immersed in or in contact with the pulp to become covered with a tenacious coating composed of oily flotation reagents and fine particles of minerals and gangue which clog the minute openings through which air is introduced into the pulp by the air diffusers. Another shortcoming is the tendency of the rising column of air bubbles to become channelized and thereby to unevenly aerate the aqueous pulp.

Such air diffusers may be disposed at different levels within the flotation machine, the air diffusers being in tubular form and spaced horizontally to provide relatively large and unobstructed passages for the aqueous pulp to descend therebetween. In its descent, the pulp is therefore either not retarded at all or only minimally in contrast with the present invention which deliberately retards such descent thereby to prolong the suspension during which bubbles have a greater probability of becoming attached to the floatable particles.

A still further deficiency in certain of the prior art apparatuses resides in the development of circulating currents within the flotation compartment which terminate in the discharge, these currents carrying with them some of the desired, floatable material which is lost as tailings.

This is particularly true when plugging of the aeration tubes becomes uneven.

Other prior art relating to the concentration of minerals by flotation is disclosed in U.S. Pat. Nos. 4,287,054; 2,753,045 and 3,298,519.

SUMMARY OF THE INVENTION

The apparatus of this invention overcomes one or more of the foregoing problems thereby contributing to efficiency of operation. This apparatus includes a flotation compartment adapted to contain a relatively quiescent body of aqueous pulp. Pulp feed means introduces aqueous pulp into the flotation compartment, and froth overflow means disposed adjacent to the upper end of the flotation compartment provide for the discharge of a float fraction containing floated particles of the aqueous pulp. A hydraulic compartment is disposed beneath the flotation compartment and is adapted to contain a body of aerated water maintained at a higher static pressure than that of the aqueous pulp in the lower portion of the flotation compartment. A constriction plate separates the flotation compartment from the hydraulic compartment disposed therebeneath, the constriction plate having a plurality of spaced orifices for uniformly distributing aerated water thereacross from the hydraulic compartment to the flotation compartment. Each orifice is adapted to receive therethrough a stream of aerated water from the hydraulic compartment into the lower portion of the flotation compartment.

Means is provided for introducing air and water into the hydraulic compartment and for forming a multitude of air bubbles throughout the water in the hydraulic compartment, such means conventionally including an aspirating device but is not restricted thereto.

Underflow means is provided for discharging the non-float fraction containing unfloated particles of the aqueous pulp from the flotation compartment.

Means are provided within the flotation compartment to retard the downward descent of the aqueous pulp for prolonging the period of suspension therein. The longer the pulp is in suspension, the greater are the probabilities of an air bubble becoming attached to a floatable particle.

For retarding such downward descent of the pulp, retardation plate means may be used which spans the flotation compartment intermediate its upper and lower ends. The plate means is provided with a plurality of spaced apertures to receive rising bubbles and descending pulp therethrough, the spaces between apertures being impermeable thereby serving as obstructions in the descent paths of the descending particles. Such particles are thereby altered in the course of descent to transverse paths which lead through respective apertures.

The retardation device may include one or more additional hydraulic compartments disposed in spaced relation vertically within the flotation compartment, each of the hydraulic compartments having relatively large openings therethrough which accommodate the downward passage of the aqueous pulp. Each of the hydraulic compartments contributes to further fluidizing and aeration of the pulp within the flotation compartment, such that a relatively dense collection of bubbles is provided in the upper portion of the flotation compartment which enhances the probabilities of the further fluidized and suspended float fraction being picked up and carried to the recoverable froth.

The number of such retarding devices used in the flotation compartment will depend to some extent upon the particular ores being concentrated. The number of such devices as well as the spacing therebetween upon being optimized can prevent the development of the recirculating currents as mentioned hereinabove which can contribute to loss in efficiency by reason of the undesired discharge of some of the float fractions.

In view of the foregoing it is an object of this invention to provide for improvements in flotation apparatus for obtaining an increase in operating efficiency. Included within such object is the object of retarding the downward descent of aqueous pulp for prolonging the period of suspension thereby to enhance the probabilities of bubbles becoming attached to the floatable particles.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE EMBODIMENTS

Figure 1:
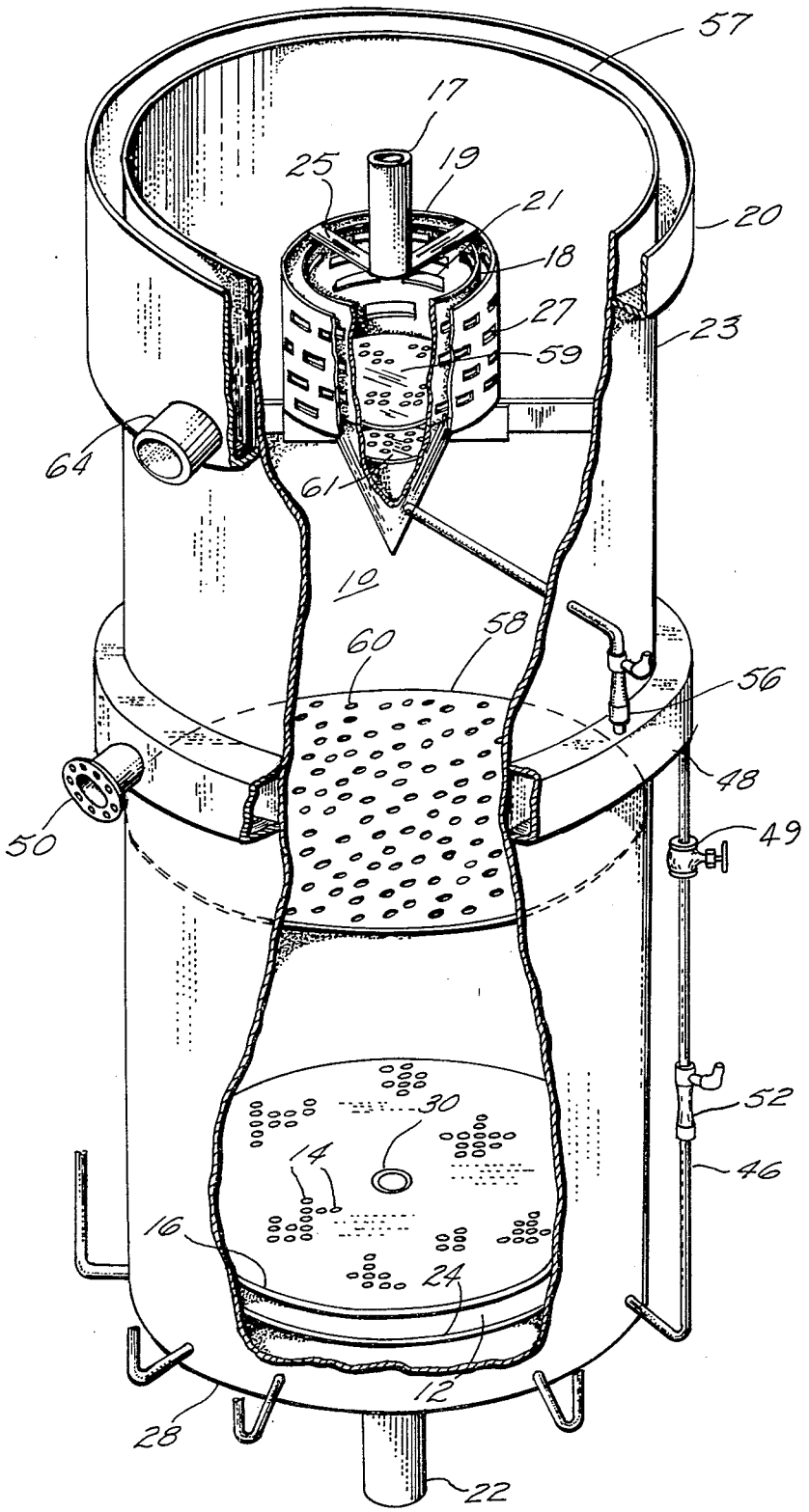
FIG. 1 is a perspective view partially broken away and sectioned for clarity of illustration of one embodiment of the present invention.

Referring to FIG. 1 for a general description, the flotation apparatus comprises a flotation compartment 10 adapted to contain a body of aqueous pulp to be separated into float and non-float fractions, a hydraulic compartment 12 being disposed directly below the flotation compartment 10 and adapted to contain a body of aerated water that is introduced into the flotation compartment through orifices 14 formed in the constriction plate 16 which serves as the bottom wall of the compartment 10. A pulp feed pipe 17 and an apertured pulp feed well 18 are provided adjacent the upper end of the apparatus for introducing a conditioned aqueous pulp into the flotation compartment 10, and an apertured dispersion sleeve 19 coaxially surrounds the feed well 18. An annular, froth overflow launder 20 is provided adjacent to the upper end of the flotation compartment 10 for withdrawing the float fraction therefrom. Underflow discharge means or pipe 22 is provided adjacent to the lower end of the flotation compartment 10 for withdrawing underflow or non-float material from the flotation compartment 10.

Figure 4:
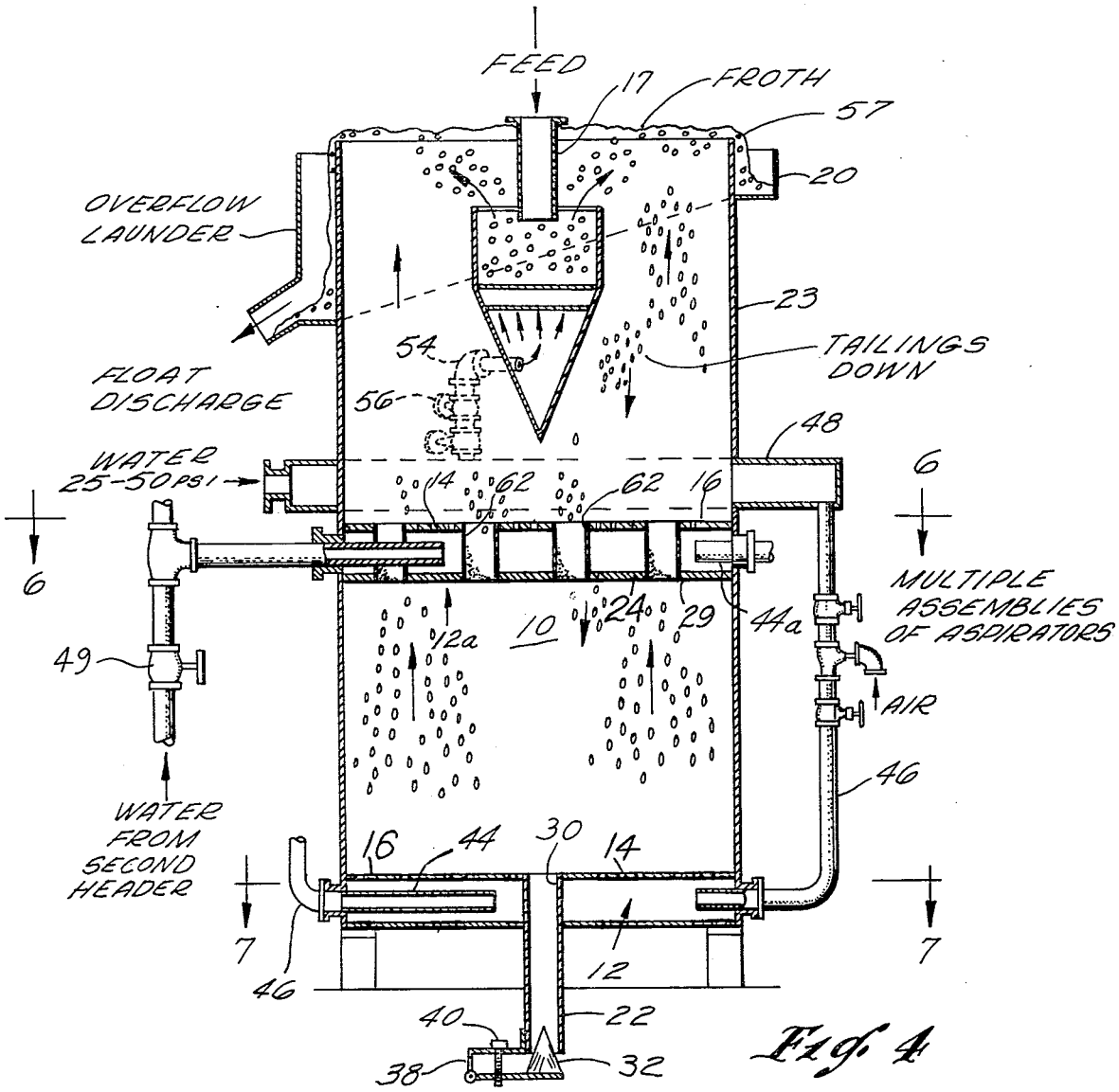
FIG. 4 is a longitudinal sectional view of another embodiment of this invention which discloses the use of an additional hydraulic compartment instead of the retardation plate of FIGS. 1 and 2.

The flotation compartment 10 has a substantially circular cross-section defined by the cylindrical wall 23, the constriction plate 16 serving, as previously noted, as the bottom wall of the flotation compartment 10. The hydraulic compartment 12 is defined by the constriction plate 16 which serves as the top wall thereof, by the cylindrical wall 23 and a second plate 24 spaced below and extending parallel to the constriction plate 16, the constriction plate 24 serving as the bottom wall of the hydraulic compartment 12. The underflow discharge means 22 in FIGS. 1 and 4 is in the form of a straight duct or pipe coaxially centered with respect to the wall 23 and sealingly secured at its upper end to and opening through the constriction plate 16, such opening being indicated by the numeral 30. The constriction plate 24 is sealingly secured to the outer periphery of the pipe 22 as shown. A cone-shaped valve 32 is disposed for movement within the lower end of the pipe 22 as shown, the valve 32 being mounted on a lever 34 pivoted at 36 to a bracket 38 secured to the lower end of the pipe 22. A screw adjustment 40 is received by the bracket 38 and threads into the lever 34, rotation of the screw 40 serving to move the valve 32 vertically. The valve 32 serves in controlling the rate of discharge of water and non-float fraction from the flotation compartment 10. While valve 32 is shown as one device for controlling discharge, other valve devices may be used, a conventional pinch valve which is controlled by air pressure being an example and preferred in a commercial embodiment of the over all apparatus.

Figure 2:
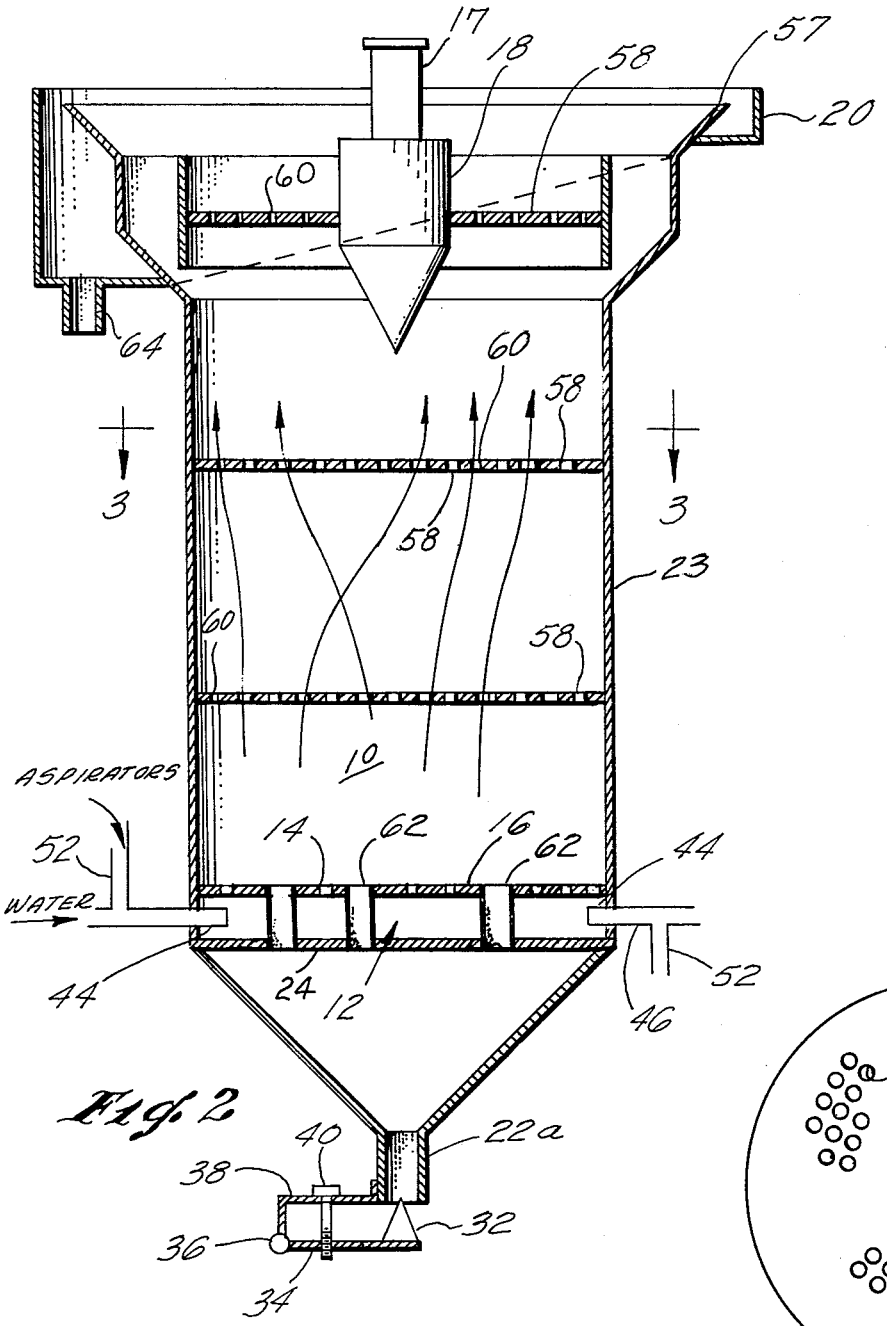
FIG. 2 is a longitudinal sectional view of essentially the same embodiment but with three retardation plates being used instead of one.
Figure 3:
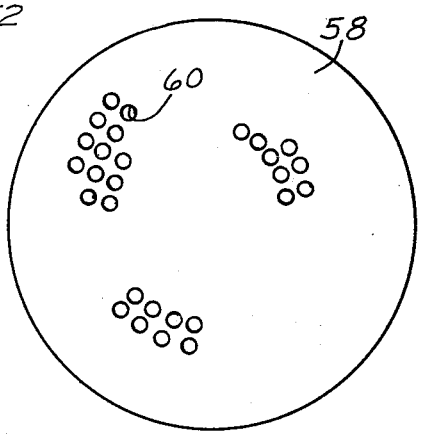
FIG. 3 is a cross-section taken substantially along the section line 3—3 of FIG. 2 showing in particular the design of one of the retardation plates.

The design of FIG. 2 is essentially the same with the discharge pipe being indicated by numeral 22*a*, and connected to a tapered chamber beneath hydraulic compartment 12.

Figure 6:
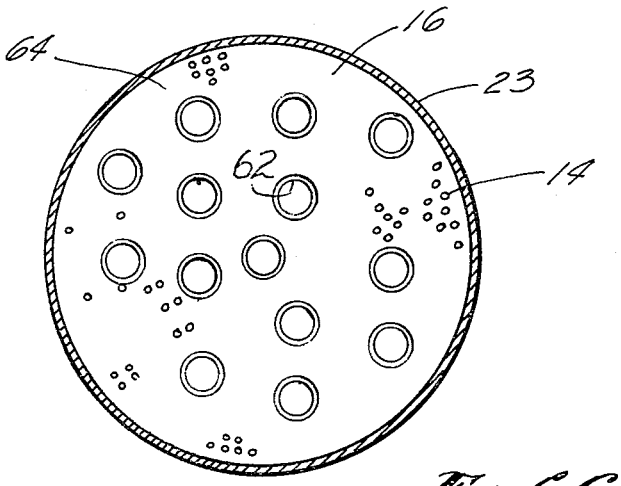
FIG. 6 is a cross-section taken substantially along section line 6—6 of FIG. 4 and showing in particular the design of the constriction plate of the intermediate hydraulic compartment.

The orifices 14 in the constriction plate 16 are uniformly spaced, such as on two to three inch centers, as shown in FIG. 6 and in one working embodiment are of a size ranging from one-eighth to five-sixteenths inch.

Figure 7:
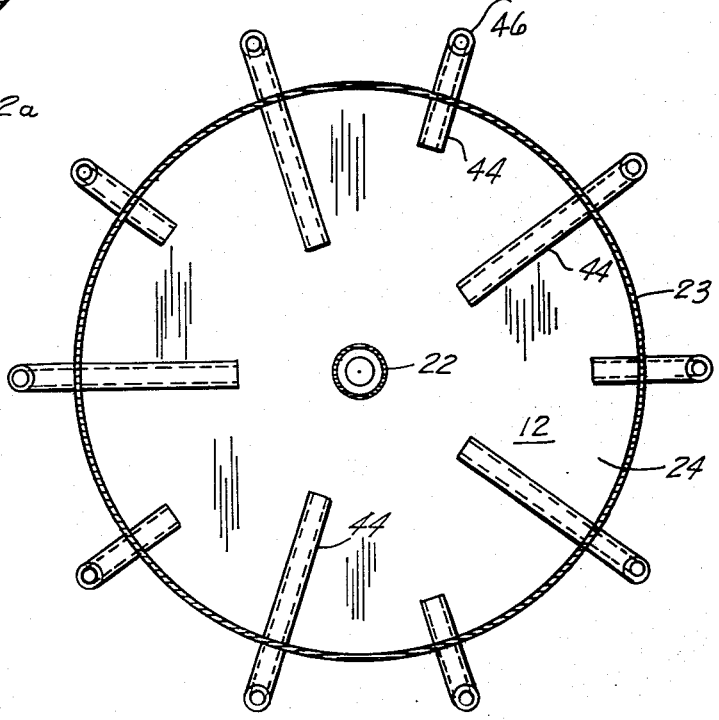
FIG. 7 is a cross-section through one of the hydraulic compartments and in particular along section line 7—7 of FIG. 4.

It is important that the hydraulic compartment 12 contain a uniformly aerated body of water maintained at a slightly higher pressure than that of the aqueous pulp in the flotation compartment 10. Accordingly, the hydraulic compartment 12 is provided with means for introducing air and water thereinto and with means for forming a uniform dispersion of minute air bubbles through the water in the compartment. The functions of the air and water introducing means as well as the air dispersing means may be essentially the same as disclosed in U.S. Pat. No. 3,371,779, but as shown in the drawings, are alternatively provided in part by the compartment 12 having therein a series of circumferentially arranged, radial pipe extensions 44 (FIG. 7) of different length. These extensions 44 are connected to pipes 46 leading to an annular, water manifold 48 having a fitting 50 to which water at a pressure of, for example, 25 to 50 pounds per square inch is connected. In series with each of the pipes 46 is a conventional aspirator 52. Such an aspirator may also be the same as that shown in the aforesaid U.S. Pat. No. 3,371,779, see FIGS. 1 and 5 thereof for example.

Another pipe 54 is connected at one end to the manifold 48 and at the other end to the feed well 18. An aspirator 56 like the aspirator 52 is connected in series with the pipe 54.

It is important in the operation of the apparatus described that water and aerating air be introduced into the hydraulic compartment 12 at a rate sufficient to insure that the static pressure in the hydraulic compartment 12 is above the static pressure of the aqueous pulp in the lower portion of the flotation compartment 10. Specifically, it has been found that the pressure differential between the aerated water in the hydraulic compartment 12 and the aqueous pulp in the lower portion of the flotation compartment 10 not be permitted to fall below about 0.5 pounds per square inch, and preferably not below about 1 pound per square inch, in order to maintain the hydraulic compartment 12 substantially free of aqueous pulp. A preferred operating range is from about 2 to 4 pounds per square inch. For one operating mode, the rate of aerated water injection just equals the discharge from pipe 22, 22*a* such that the level of liquid within compartment 10 is maintained at or just below the upper edge 57.

Figure 5:
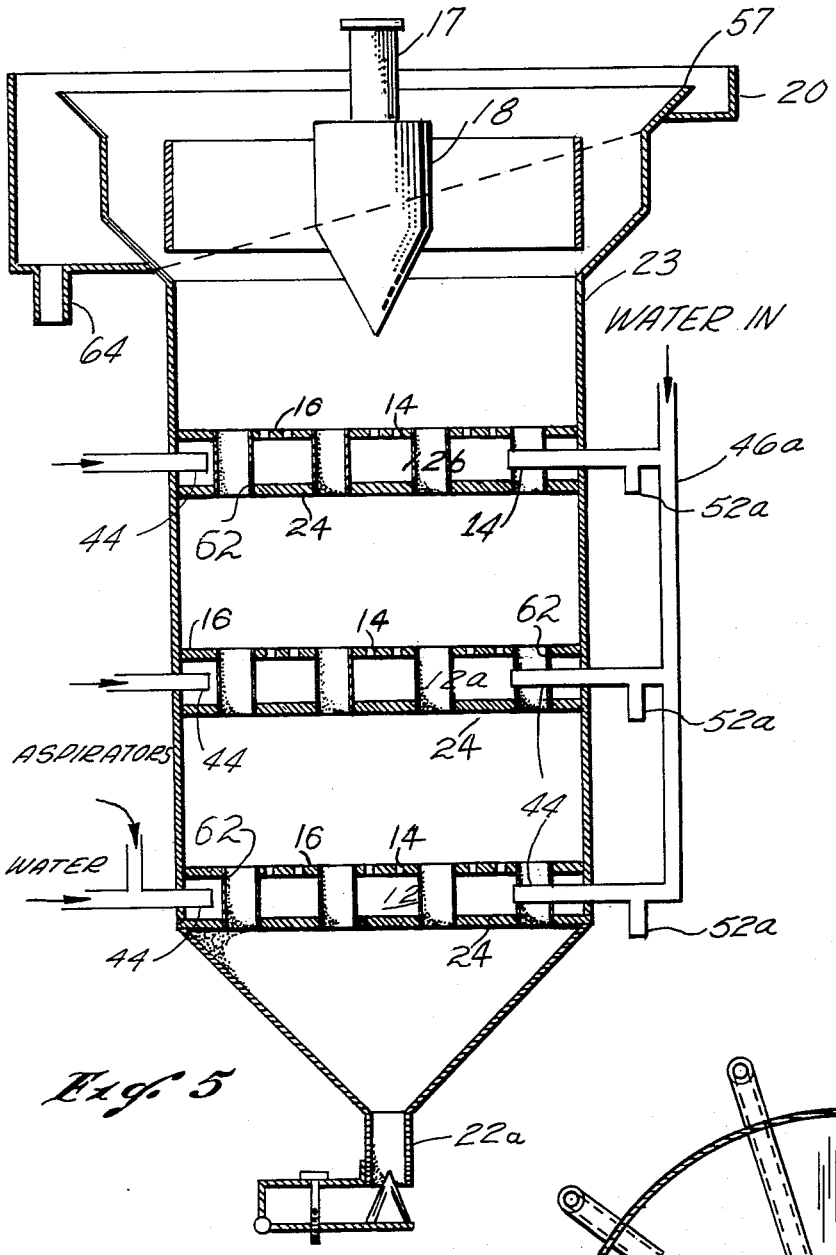
FIG. 5 is another longitudinal sectional view of essentially the same embodiment but with an additional hydraulic compartment being installed.

Water flowing in the pipes 46 and 54 is mixed with air drawn from the surrounding atmosphere by means of the aspirators 52 and 56, respectively. The water flowing into the aerating compartment 12 is thus aerated, this aerated water flowing upwardly through the orifices in the constriction plate 16 into the flotation compartment 10. The orifices 14 receive therethrough a plurality of streams of uniformly aerated water. In this connection, it is important to note that the constriction plate 16 is not primarily an air diffuser and that the orifices in the constriction plate are not intended to control the size of the air bubbles, the stream of water flowing through each orifice already being aerated with a multitude of minute, uniformly dispersed air bubbles. The orifices 14 are relatively large and are distributed in a relatively widely spaced geometric pattern across the entire area of the constriction plate in order to insure uniform distribution of the aerated water being introduced into the flotation compartment and, thereby to insure uniform aeration of the aqueous pulp in the flotation compartment. Air bubbles may also be provided by means of a mechanically operated impeller-type air diffuser as shown in FIG. 5 of the aforesaid U.S. Pat. No. 3,371,779.

In operation, the pulp to be separated is delivered at a suitable rate into the feed well 18 where it encounters aerated water delivered thereby by the pipe 54, air bubbles passing upwardly through spaced, apertured, constriction plates 59 and 61 therein which carry the floatable fractions upwardly and horizontally into the flotation compartment 10. The usual flotation reagents as disclosed in the aforesaid U.S. Pat. No. 3,371,779 are introduced into the feed well as desired by first being thoroughly mixed with the pulp feed before it is fed to the feed well 18.

More specifically, the wall of the feed well 18 is provided with apertures 21 either round or elongated, the latter being preferred, also, the dispersion sleeve 19 is provided with like apertures 27, sleeve 19 being mounted on the feed well 18 by means of bar-like braces 25. Aerated pulp not only flows upwardly out of the well 18 but also through apertures 21 and 27, there to encounter further aeration in the compartment 10. When treating dilute pulp delivered at a high rate, it is particularly desirable to have this design of feed well. The presence of the apertures 21 and 27 tends to reduce turbulence and boiling and to disperse the content of the feed well less vigorously than would be the case if no apertures were used. The elongated, circumferential arrangement of the apertures provides a ribbon-like, radial flow offering maximum exposure to the levitating bubbles in compartment 10.

The froth that forms on the upper surface of the aqueous pulp in the flotation compartment 10 contains the floatable particles from the aqueous pulp which overflows into the annular launder 20 and out of the float discharge pipe 64. The essentially non-floatable particles entering the flotation compartment 10 gravitate downwardly to be discharged through the pipe 22. The rate of discharge as explained previously is controlled by means of the valve 32. The floatable particles not captured and floated at the feed well as they settle through flotation compartment 10 are subjected to continuous floating action by the rising bubbles in the compartment 10. The pulp feed is thereby separated in the manner described in the aforesaid U.S. Pat. No. 3,371,779 into the desired and undesired constituents.

There is a natural downward circulation of pulp in the flotation compartment counter to the upward currents of air bubbles. Since the height of the flotation compartment may range somewhere between 6 to 30 feet, and preferably 10 to 18 feet, some period of time is required for the pulp residue to reach the bottom of the flotation compartment and to be discharged through the drain 22, 22*a*. During this period of suspension, many opportunities are presented for float particles to be carried upwardly by attachment to rising air bubbles. While this relatively quiescent column of pulp provides a high probability of attachment of bubbles to float particles, it is possible that some of these will find their way to the discharge and thus be lost as part of the tailings. In order to increase the probabilities of attachment, pulp-retardation means are provided within the flotation compartment 10 for the purpose of slowing or retarding the descent of the aqueous pulp within the flotation column. In FIGS. 1 and 2, this pulp-retarding means is in the form of an apertured aeration plate or plates 58 disposed intermediate the ends of the flotation compartment 10. These plates 58 are provided with a series of openings 60 of about five-eighths inch or one and one-quarter inches on two inch centers.

With the plane of the plate or plates 58 at right angles to the axis of the flotation compartment 10, the aqueous pulp that eventually finds its way out of the discharge pipe 22, 22*a* must pass therethrough. The apertures 60 are provided in sufficient number, size and spacing as to insure that the descending pulp, especially the coarser non-float particles, in the upper portion of the flotation compartment 10 will eventually find its way through the plate 58 and into the flotation compartment therebelow. Rising air bubbles from the hydraulic compartment 12 pass through all of the apertures 60 such that float fraction may become attached to the rising air bubbles in both the upper and lower portions of compartment 10. Those floatable particles becoming attached in the lower portion of compartment 10 rise upwardly to the surface thereof, passing through the apertures 60 counter to the direction of the descending material.

The apertures 60 are made to such size, number and spacing as to result in the retardation of the downward progress of the aqueous pulp. The purpose of the plate 58 is to slow down the descent so as to prolong the period of suspension thereby increasing the probability of bubble attachment. The plate 58 and the spaces between apertures 60 therefore constitutes a barrier or obstruction against the downward movement of the particles. Therefore, there must be sufficient barrier portion presented on the plate 58 to slow down the descent. If there are too many apertures 60, the aqueous pulp will descend at a more or less uniform rate without any particular prolongation within the compartment 10. At the other extreme, if there are too few apertures or if the apertures are too small, the descending pulp could collect on the plate and clog the apertures. The compromise between these two extremes results in descending particles not in vertical alignment with a particular aperture being caused to move transversely until it becomes aligned with an aperture and then gravitates therethrough. This obstruction therefore slows or impedes the descent thereby prolonging the time in suspension.

The apertures 60 typically may be five-eighths inch in diameter and on two inch centers or one and one-quarter inches on two inch centers, the latter being preferred in a working embodiment. For the five-eighths inch holes, the degree of openness in plate 58 is about eight percent (8%) of the total, which will work for some materials; however, to accommodate a broader range of materials, the degree of openness should be about twenty-five percent (25%) to about forty-five percent (45%), and preferably about thirty percent to forty percent (30%–40%).

A further design consideration, instrumental in the retardation is the passage of the levitating air bubbles through the apertures 60. Since the air bubbles in the lower portion of the flotation compartment 10 are substantially uniform thereacross, and since the barrier portions on the plate 58 interfere with the upward transit of some of the bubble, such bubbles will be diverted transversely to pass through adjacent apertures 60. The streams of bubbles as they pass through the apertures desirably increase in velocity, in some instances by a factor of two, the size of the aperture 60 being instrumental in assuring this increase. Therefore, as another design factor, the apertures 60 are made to such size as will provide such a velocity increase. This increased velocity tends to keep the aperture 60 clean and further provides an upward current which tends to impede the downward flow of and to disperse the pulp.

A still further feature in the design relates to the reduction of induced circulatory currents within the flotation compartment 10 which are somewhat circular in shape with upward and downward components, these currents exiting the discharge pipe 22. Unfortunately, some float fraction which becomes caught in these currents is discharged and therefore lost. Such currents deleteriously affect the efficiency of operation, so to this extent, the development of such currents should be reduced wherever possible. Strategic location of the plate 58 with reference to the constriction plate 16 can serve in either reducing or eliminating entirely such currents.

Referring to FIG. 2, this embodiment is illustrated primarily for the purpose of explaining that a plurality of such plates 58, specifically three as shown, may be used in vertically spaced relation. The vertical spacing between these plates is so selected as to optimize the features and results just explained, the first being to retard the descent of the pulp and the second being to minimize the development of the circulatory currents that carry out some of the desired float fraction. Another difference in the embodiment of FIG. 2 resides in the design of the hydraulic chamber there shown, this chamber differing primarily in the fact that the upper and lower plates 16 and 24 are provided with a plurality of vertically aligned, relatively large pipes or ducts 62 extending through compartment 12, which are radially spaced apart, and are of a size and spacing as will adequately accommodate low velocity downward passage and discharge of the undesired float fractions from the discharge pipe 22*a*. In one working embodiment, these ducts 62 are about two inches in diameter, spaced 6 to 8 inches apart in a cell diameter of about 8 feet diameter.

Reference is now made to the embodiment shown in FIGS. 4 through 8. The embodiment of FIG. 4 is essentially the same as that as shown in FIG. 1 with the exception that the retardation device instead of being an apertured plate like plate 58 (FIG. 1) is another hydraulic compartment, indicated by the numeral 12*a*. Its construction is like that of the hydraulic chamber 12 of FIG. 2, like numerals indicating like parts. In this embodiment, the plate 16 has apertures 14 of a size and spacing as previously described in connection with the corresponding plates of the hydraulic compartment of FIG. 1. Aerated water is fed to the compartment 12*a* from the header 48 the same as for the compartment 12 or, alternatively, may be fed from a different header (not shown) like header 48 which contains water at the same or different pressure as may be desired. Further, a manually operated flow control valve 49 may be series connected in the line feeding extensions 44a. Static pressure within the compartment 12a still must be sufficiently above that in the flotation compartment that aerated water will flow therefrom. Air bubbles pass through the orifices 14 into the upper portion of the flotation compartment 10. The presence of the compartment 12a, the rising air bubbles from both compartments 12 and 12a and the regulated inflow of fluidizing water, individually and collectively serve in impeding the downward movement and enhances dispersion of the aqueous pulp. This results in prolonging the descent of the particulate matter and further fluidizes the aqueous pulp providing further separation between particles thereby increasing the probabilities of bubble attachment. Since aerated water is introduced into the flotation compartment at two different levels, bubble density in the upper part of the compartment will of course be greater than that in the lower part. The greater bubble density also increases the opportunities for bubble attachment and separation of the float fraction from the descending pulp. The number of ducts 62 in compartment 12a must be adequate to accommodate upward flow of bubbles which emanate from compartment 12 into the uppermost portion of flotation compartment 10.

FIG. 5 illustrates a slightly different embodiment in which an additional hydraulic compartment 12b is installed between the compartment 12a and the upper end of the cell. The spacing between hydraulic compartments, the arrangement of the various apertures and the water pressures injected thereinto are adjusted and optimized to enhance the pickup and separation of the float fraction from the column of pulp. These parameters will vary with different ores being treated. Each hydraulic compartment 12, 12a, 12b, etc., preferably has a control valve like valve 49 in circuit therewith thereby to control the rate and pressure of aerated water delivered. These valves are adjusted to maximize the recovered float fraction, different ores requiring different adjustments. Within limits, these valves also control the volume of air bubbles, an increase in flow generally aspirating more air.

By reason of the presence of the retardation plates 58 and the hydraulic compartments 12a, 12b, etc., within the flotation compartment 10, the overall height of the apparatus may be kept substantially the same as that of similar prior art cells, referring in particular to Hollingsworth U.S. Pat. No. 4,287,054, but with the amount of float fraction recovered being greater. This improvement in efficiency means that less of the desired material is lost through discharge thereby providing a savings in the form of more of the available, desired material being recovered. Insofar as the types of materials separated, the constituency of the feed, the reagents and surfactants which may be used, examples are disclosed in prior U.S. Pat. No. 3,371,779.

Tests were conducted using a scaled down version in which the flotation compartment was three and one-quarter inches (3¼") in diameter and thirty inches (30") high having three retardation plates as shown in FIG. 2, the materials used and results being as follows.

EXAMPLE NO. 1

Phosphate

A −6 mesh feed was conditioned with caustic soda, fuel oil and a fatty acid at about 70% solids, then fed by hand to the cell.

| | With Plates 58 | Without Plates 58 | Lbs./Ton Feed | | |
|---|---|---|---|---|---|
| | % Wt. | % Wt. | NaOH | F. Oil | F. Acid |
| Concentrate | 56.7 | 36.2 | | | |
| Tailings | 43.3 | 63.8 | | | |
| | 100.0 | 100.0 | 0.24 | 1.66 | 1.66 |

EXAMPLE NO. 2

Vermiculite

A −6 mesh vermiculite feed was reagentized by conditioning for 30 seconds (about 70% solids) with Amine 400 and Diesel Oil, then floated in the cell with and without retardation plates 58.

| | With Plates 58 | Without Plates 58 | Lbs./Ton Feed | |
|---|---|---|---|---|
| | % Wt. | % Wt. | Amine 400 | Diesel Oil |
| Concentrate | 25.7 | 15.8 | | |
| Tailings | 74.3 | 84.2 | | |
| | 100.0 | 100.0 | 0.28 | 2.46 |

While there have been described above the principles of this invention in connection with specific apparatus, it is to be clearly understood that this description is made only by way of example and not as a limitation to the scope of the invention.

What is claimed is:

1. Apparatus for separation of minerals from an aqueous pulp containing a mixture of mineral and gangue particles by froth flotation comprising:

an upstanding flotation compartment adapted to contain a relatively quiescent body of aqueous pulp, means for introducing aqueous pulp into said flotation compartment, means disposed adjacent to the upper end of said flotation compartment for collecting a float fraction of said aqueous pulp, first means for supplying air and water to said flotation compartment near the bottom whereby bubbles of air are introduced throughout substantially the entire cross-section thereof, retardation plate means extending across the full cross-section of said flotation compartment intermediate the upper and lower ends thereof for retarding the descent of said pulp, said plate means having a plurality of spaced apertures throughout the area thereof to receive rising bubbles and descending particles of said pulp therethrough, said plate means between said apertures being impermeable and serving as an obstruction in the descent paths of some of the descending particles which are thereby altered in the course of descent to transverse paths leading through the apertures, the size, number and spacing of said apertures further being such as to:

(a) receive the descending non-float fraction therethrough without collecting on said plate means and at a rate less than would be the case in the absence of said plate means, and (b) receive ascending bubbles from below said plate means which increases in velocity as they rise therethrough, and means for discharging a non-float fraction of unfloated particles of said aqueous pulp past said first means and from the lower end of said flotation compartment.

2. The apparatus of claim 1 wherein said plate means is a flat horizontal plate.

3. The apparatus of claim 2 wherein said flotation compartment is cylindrically shaped and of substantially uniform diameter.

4. The apparatus of claim 2 wherein said apertures are of about $\frac{5}{8}''$ to about $1\frac{1}{4}''$ diameter spaced on two inch centers.

5. Apparatus for separation of minerals from an aqueous pulp containing a mixture of mineral and gangue particles by froth flotation comprising:

an upstanding flotation compartment adapted to contain a relatively quiescent body of aqueous pulp, means for introducing aqueous pulp into said flotation compartment, means disposed adjacent to the upper end of said flotation compartment for collecting a float fraction of said aqueous pulp, first means for supplying air and water to said flotation compartment near the bottom whereby bubbles of air are introduced throughout substantially the entire cross-section thereof, a second means for supplying air and water to said flotation compartment intermediate the upper end thereof and said first means, said first and second means each being in the form of first and second hydraulic compartments, respectively, having constriction plates extending across the full cross-section of said flotation compartment, said constriction plates having a plurality of spaced apertures throughout the area thereof, each aperture being adapted to receive therethrough a stream of water from the underside of the respective constriction plate into said flotation compartment thereabove, said water being supplied to each hydraulic compartment, said water containing a multitude of air bubbles which pass upwardly through said apertures, said retardation plate means being the constriction plate of said second hydraulic compartment, and said second hydraulic compartment having a plurality of spaced pulp-passing ducts therethrough which are larger than said apertures whereby aqueous pulp may descend and levitating bubbles may pass, said ducts being of a size, number and spacing as receives the descending non-float fraction therethrough without collecting on the constriction plate of said hydraulic compartment and at a rate less than would be the case in the absence of said hydraulic compartment, thereby retarding the descent of said pulp between the upper and lower ends thereof.

6. The apparatus of claim 5 wherein said ducts are in the form of short pipes extending between said constriction plates and bottom plates.

7. The apparatus of claim 6 wherein said ducts are about two inches in diameter on centers of from about six to eight inches.

8. The apparatus of claim 5 wherein said first and second hydraulic compartments have a spacing therebetween and the number, size and spacing of said ducts and apertures being such as inhibits the development of circulating currents within said flotation compartment which otherwise would carry float fraction out of said discharging means.

9. The apparatus of claim 8 including adjustable valve means for controlling the air and water delivered to either or both of said first and second hydraulic compartments, whereby adjustment of said valve means serves to maximize the amount of float fraction recovered from said aqueous pulp.

10. Apparatus for separation of minerals from an aqueous pulp containing a mixture of mineral and gangue particles by froth flotation comprising:

an upstanding flotation compartment adapted to contain a relatively quiescent body of aqueous pulp, means for introducing aqueous pulp into said flotation compartment, means disposed adjacent to the upper end of said flotation compartment for collecting a float fraction of said aqueous pulp, first means for supplying aerated water to said flotation compartment near the bottom whereby bubbles of air are introduced throughout substantially the entire cross-section thereof, means for discharging a non-float fraction of unfloated particles of said aqueous pulp past said first means and from the lower end of said flotation compartment, and means for retarding the descent of aqueous pulp within said flotation compartment which serves in increasing the float fraction recovered as compared with the amount recovered in the absence of such retarding means, said retarding means including a plate which extends substantially across the full cross-section of said flotation compartment and has a plurality of spaced apertures throughout the area thereof to receive rising bubbles and descending particles therethrough, said plate means between said apertures being impermeable and serving as an obstruction in the descent paths of some of the descending particles which are thereby altered in the course of descent to transverse paths leading through the apertures, the size, number and spacing of said apertures further being such as to:

(a) receive the descending non-float fraction therethrough without collecting on said plate means and at a rate less than would be the case in the absence of said plate means, and (b) receive ascending bubbles from below said plate means, which increase in velocity as they rise therethrough.

11. Apparatus for separation of minerals from an aqueous pulp containing a mixture of mineral and gangue particles by froth flotation comprising:

an upstanding flotation compartment adapted to contain a relatively quiescent body of aqueous pulp, means for introducing aqueous pulp into said flotation compartment, means disposed adjacent to the upper end of said flotation compartment for collecting a float fraction of said aqueous pulp, means for supplying bubbles of air to said flotation compartment near the bottom thereof, retardation plate means extending substantially across the full cross-section of said flotation compartment intermediate the upper and lower ends thereof for retarding the descent of said pulp, said plate means having a plurality of spaced apertures throughout the area thereof to receive rising bubbles and descending particles of said pulp therethrough, said plate means between said apertures being impermeable and serving as an obstruction in the descent paths of some of the descending particles which are thereby altered in the course of descent to transverse paths leading through the apertures, the size, number and spacing of said apertures further being such as to:

(a) receive the descending non-float fraction therethrough without collecting on said plate means and at a rate less than would be the case in the absence of said plate means, and (b) receive ascending bubbles from below said plate means, which increase in velocity as they rise therethrough, and means for discharging a non-float fraction of unfloated particles of said aqueous pulp past said first means and from the lower end of said flotation compartment.

* * * * *